US010076732B2

(12) United States Patent
Kontos et al.

(10) Patent No.: US 10,076,732 B2
(45) Date of Patent: Sep. 18, 2018

(54) LAB RACK ROTATOR AND METHODS THEREOF

(71) Applicant: TRUE HEALTH IP LLC, Frisco, TX (US)

(72) Inventors: Greg Kontos, Richmond, VA (US); Jobin Abraham, Henrico, VA (US); Jason Branch, Richmond, VA (US); Will Renzulli, Richmond, VA (US); Ali Safavi, Chester, VA (US)

(73) Assignee: True Health IP LLC, Frisco, TX (US)

( * ) Notice: Subject to any disclaimer, the term of this patent is extended or adjusted under 35 U.S.C. 154(b) by 0 days.

(21) Appl. No.: 14/074,306

(22) Filed: Nov. 7, 2013

(65) Prior Publication Data

US 2014/0133264 A1 May 15, 2014

Related U.S. Application Data

(60) Provisional application No. 61/724,739, filed on Nov. 9, 2012, provisional application No. 61/782,559, filed on Mar. 14, 2013.

(51) Int. Cl.
*B01F 9/00* (2006.01)

(52) U.S. Cl.
CPC ..... *B01F 9/0021* (2013.01)

(58) Field of Classification Search
CPC .... B01F 9/0014; B01F 9/0016; B01F 9/0018; B01F 9/002; B01F 9/0021; B01F 11/0008; G01N 35/025; G01N 2035/00524
USPC ..... 366/214, 218; 211/77, 78; 422/560–562
See application file for complete search history.

(56) References Cited

U.S. PATENT DOCUMENTS 6,386,749 B1 * 5/2002 Watts et al. ..... 366/144
6,416,455 B1 * 7/2002 Aizawa ..... B04B 5/0414 494/16
2007/0064522 A1 * 3/2007 Etheridge ..... B01F 9/002 366/214

* cited by examiner

*Primary Examiner* — Tony G Soohoo
*Assistant Examiner* — Elizabeth Insler
(74) *Attorney, Agent, or Firm* — Perkins Coie LLP

(57) ABSTRACT

A lab rack rotator includes a motor coupled to a shaft arranged to rotate in at least one direction in response to the motor. One or more mounts are located along the surface of the shaft and are configured to receive a lab sample rack which holds a plurality of lab samples contained in lab sample containers such as test tubes. Rotation of the shaft permits inversion of the plurality of lab samples, for instance whole blood samples. The lab rack rotator increases the number of lab samples that may be agitated in an automated process while decreasing the amount of time required for necessary pre-testing agitation of samples.

10 Claims, 6 Drawing Sheets

LAB RACK ROTATOR AND METHODS THEREOF

PRIORITY CLAIM

This application claims priority to U.S. Provisional Patent Application Ser. No. 61/724,739, filed on Nov. 9, 2012, and U.S. Provisional Patent Application Ser. No. 61/782,559, filed on Mar. 14, 2013, the entire contents of each of which are incorporated herein by reference and relied upon.

FIELD OF THE INVENTION

The present invention relates to automated laboratory systems and in particular to an apparatus and method for agitating lab samples in such a system. More specifically, the present invention provides a lab rack rotator and method of use thereof that allows for inversion of a large number of lab samples at a faster rate to increase throughput to meet the demands of an automated laboratory system for diagnostic testing.

BACKGROUND OF THE INVENTION

Diagnostic laboratories are becoming increasingly automated and as a result have a higher throughput for clinical analysis of laboratory samples. In order to take advantage of the increased testing speed and higher throughput, more efficient pre-diagnostic procedures are necessary to ensure large numbers of samples are prepared and available for testing.

Laboratory samples are typically stored and handled in standard sample containers, such as test tubes that may be stored in a standard test tube rack. These samples often need to be mixed and agitated prior to testing. Mixing may be required due to the settling of the samples that often occurs during storage, for incorporation of reagents prior to a reaction, for homogenization, for instigating a reaction, of for instigation precipitation or other physical and chemical changes required for laboratory sample analysis. The agitation must be performed while ensuring that the samples remained sealed. Prior agitating methods and devices have inefficiencies that may hinder the overall throughput of the laboratory.

The most commonly used method of agitation is vortexing, wherein the sample container is rapidly swirled. Vortexing is not optimal for most laboratory sample containers that have an extended height dimension. In order for vortexing to completely mix the sample, the vortex or opening void in the swirling liquid must extend from the top portion to the bottom portion of the extended height dimension of the sample container, which is a time consuming, inefficient process. Complete inversion of the sample provides a more efficient method of fulling agitating a sample.

Current inversion methods for laboratory samples, however, are also inefficient for high throughput laboratories. For example, individual samples contained in test tubes may be inverted by hand to provide the necessary agitation of the samples. Although inversion by hand quickly agitates the sample, the process is necessarily limited to one or two samples at a time and requires an employee dedicated to handling and inverting the individual samples which is time consuming and less efficient than automated processes.

Some systems provide automated agitation for a number of samples in a single process. For example, conventional rocker systems have provided the ability to agitate a larger number of samples at a single time through an automated process. Conventional rockers currently available, however, merely oscillate the samples and do not provide inversion, which results in a longer period of time required to completely agitate the samples. The process time for conventional rockers is typically between four and ten minutes to provide the necessary agitation of the samples prior to testing. Conventional rockers further require the samples to be moved from the racks on which they are stored to the rocker device which requires additional time and labor.

Commercial test tube rotators are available that provide full inversion of the samples. These rotators, however, are limited in the number of test tubes they are able to hold and, similar to the rockers described above, require that the individual tubes be moved from the racks on which they are held to the rotator prior to inversion. Thus, available sample rotators require additional time and effort that limits the overall throughput of the testing laboratory.

There is thus a need in the art to overcome these and other deficiencies.

SUMMARY OF THE INVENTION

One embodiment of this invention relates to a lab sample rack rotator comprising a motor coupled to a shaft arranged to rotate in at least one direction in response to the motor. One or more mounts are located along the shaft and are configured to receive a lab sample rack which holds a plurality of lab samples. Rotation of the shaft permits inversion of the plurality of lab samples.

Another embodiment of this invention relates to a method for agitating a plurality of lab samples comprises providing a motor coupled to a shaft arranged to rotate in at least one direction in response to the motor. One or more mounts are located along the shaft and are configured to receive a lab sample rack which holds the plurality of lab samples. The one or more lab sample racks are loaded into the one or more mounts. The shaft is rotated causing the lab samples loaded in the lab sample racks to be inverted to achieve agitation of the plurality of lab samples.

Various exemplary embodiments of this technology may offer advantages. For example, the lab rack rotator achieves agitation of a higher number of samples at a faster rate to meet the higher throughput demands of diagnostic laboratories. Further, the lab rack rotator allows for agitation while maintaining the lab samples in the racks on which they are stored, which decreases the time and labor required for the pre-testing agitation step to further increase the throughput of the lab.

DETAILED DESCRIPTION OF THE INVENTION

Figure 1B:
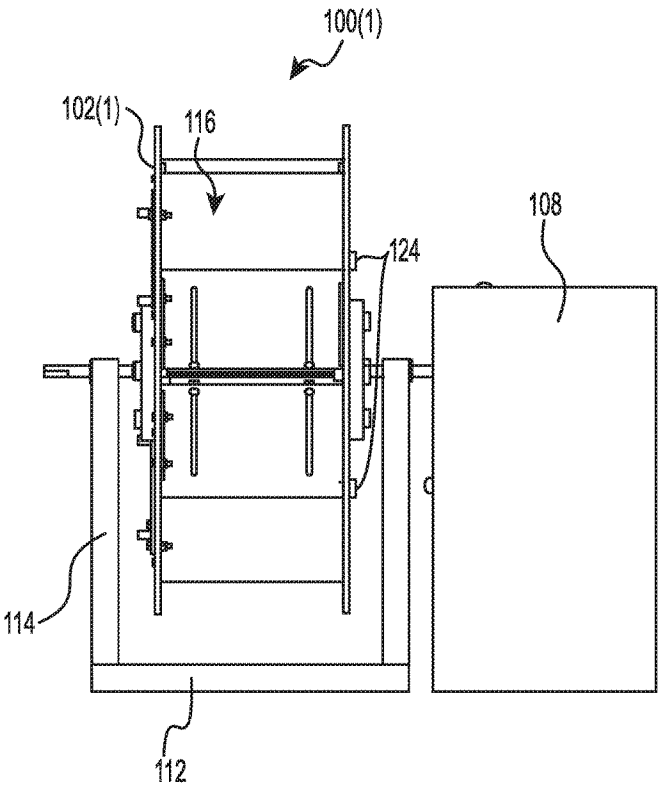
FIGS. 1A-1C are an isometric view, end view, and a side view of an exemplary embodiment of a lab rack rotator of the present disclosure.

Exemplary lab rack rotators 100(1), 100(2) are illustrated in FIGS. 1A-2C. Like elements in lab rack rotators 100(1), 100(2) are described below using like reference numerals. The like reference numerals indicate the same structure and operation except as described below. Each of the exemplary lab rack rotators 100(1), 100(2) includes a shaft 102(1), 102(2), a support structure 104, one or more mounts 106(1), 106(2) located along the shaft 102(1), 102(2), a motor 108, and one or more input devices 110. The lab rack rotators 100(1), 100(2) could include other types and numbers of devices, components, and other elements in other configurations, as well. This exemplary technology provides a number of advantages including providing agitation of a plurality of lab samples through inversion at an increased rate of speed, while maintaining the samples in the standard lab racks they are stored in to facilitate the high throughput nature of clinical laboratories.

The shaft 102(1), 102(2) of each of the exemplary lab rack rotators 100(1), 100(2) is supported by a support structure 104 configured to allow the shaft 102(1), 102(2) to rotate in at least one direction about a central axis of the shaft 102(1), 102(2), although the shaft 102(1), 102(2) may rotate in either direction. In one example, the support structure 104 includes a base 112 and arms 114, although the support structure 104 may have other configurations suitable to support the shaft 102(1), 102(2) and to allow the shaft 102(1), 102(2) to rotate in at least one direction. The length of the shaft 102(1), 102(2) can be configured depending on the size of test tube carrier to be supported. By way of example only, the length of the shaft 102(1), 102(2) may be designed to accommodate large carriers, such as a 24 tube carrier, although other embodiments specifically designed for smaller carriers, such as microwell plates, may be contemplated. In one embodiment, the length of the shaft 102(1), 102(2) is adjustable to accommodate different sizes of carriers.

The one or more mounts 106(1), 106(2) are located along the shaft 102(1), 102(2). Mounts 106(1), 106(2) are configured to receive and securely hold a lab sample rack. The lab sample rack may be any standard lab sample rack configured to hold a number of lab sample containers, such as test tubes, glass vials, thermo tubes, tubes in microtiter platers, 1 mL tubes, 50 microliter tubes, NMR tubes, or any other laboratory sample container. By way of example only, the present invention may be utilized with various Society of Biomolecular Science format plates and tube racks, or plates and tube racks that meet Standards ANSI/SLAS 1-2004 through ANSI/S LAS 4-2004, although other plates that meet other standards may be used.

In one example, the mounts 106(1), 106(2) may hold a lab sample rack capable of holding 24 individual test tubes, although mounts 106 may hold lab sample racks that hold more or less test tubes or other lab sample holders. Additionally, mounts 106(1), 106(2) may be configured to secure a plurality of racks or plates in each single mount. The mounts 106(1), 106(2) may vary in size and shape to be able to receive lab sample racks of different configurations. In one example, at least one of the mounts 106(1), 106(2) has a different size or dimension than the other mounts 106(1), 106(2) located along the shaft 102(1), 102(2), although the mounts 106(1), 106(2) may all have uniform size or dimensions. By way of example only, eight or more mounts 106(1), 106(2) may be located along the shaft 102(1), 102(2), although other numbers of mounts 106(1), 106(2) of different sizes may be utilized.

The dimensions of the mounts 106(1), 106(2) are configured to provide a secure fit for the one or more lab sample racks based on a longest dimension of the containers holding the lab samples. In one example, the mounts 106(1), 106(2) are configured such that the lab samples in the lab sample rack are maintained in a direction perpendicular to the length of the shaft 102(1), 102(2), although the lab samples may be maintained in other configurations. The mounts 106(1), 106(2) include at least one dimension configured to limit movement of the samples in the lab sample rack. By way of example only, for a lab rack holding a number of lab samples in test tubes, the mount 106(1), 106(2) is configured to provide a secure fit based on the length of the test tube such that the mount 106(1), 106(2) will provide a secure fit by limiting the freedom of movement of the lab samples in the direction of the lid of the test tube to ensure a secure fit during inversion and ensure that the sample container remains sealed.

Figure 1A:
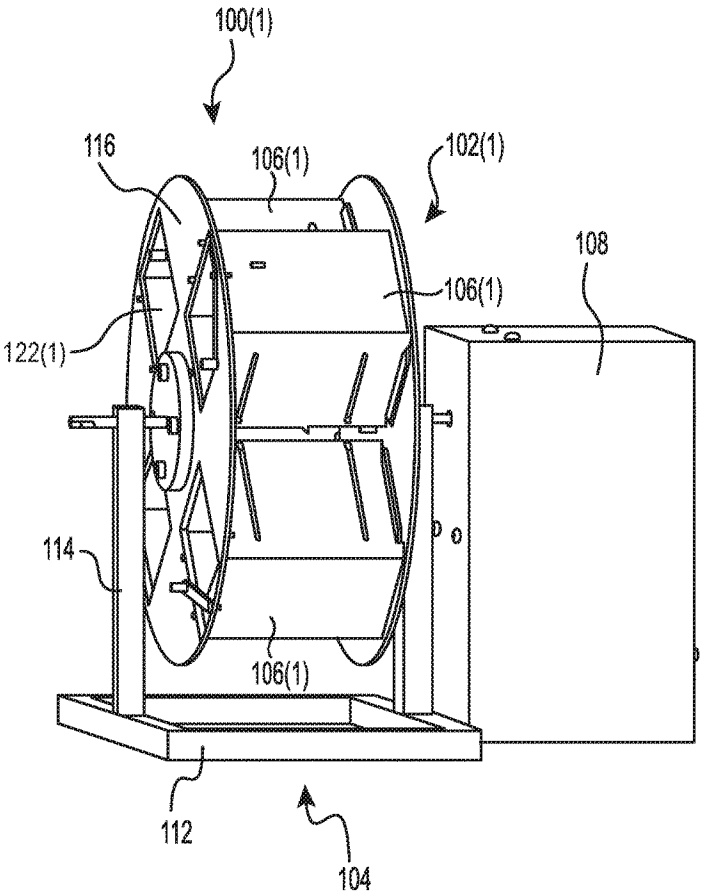
Figure 1C:
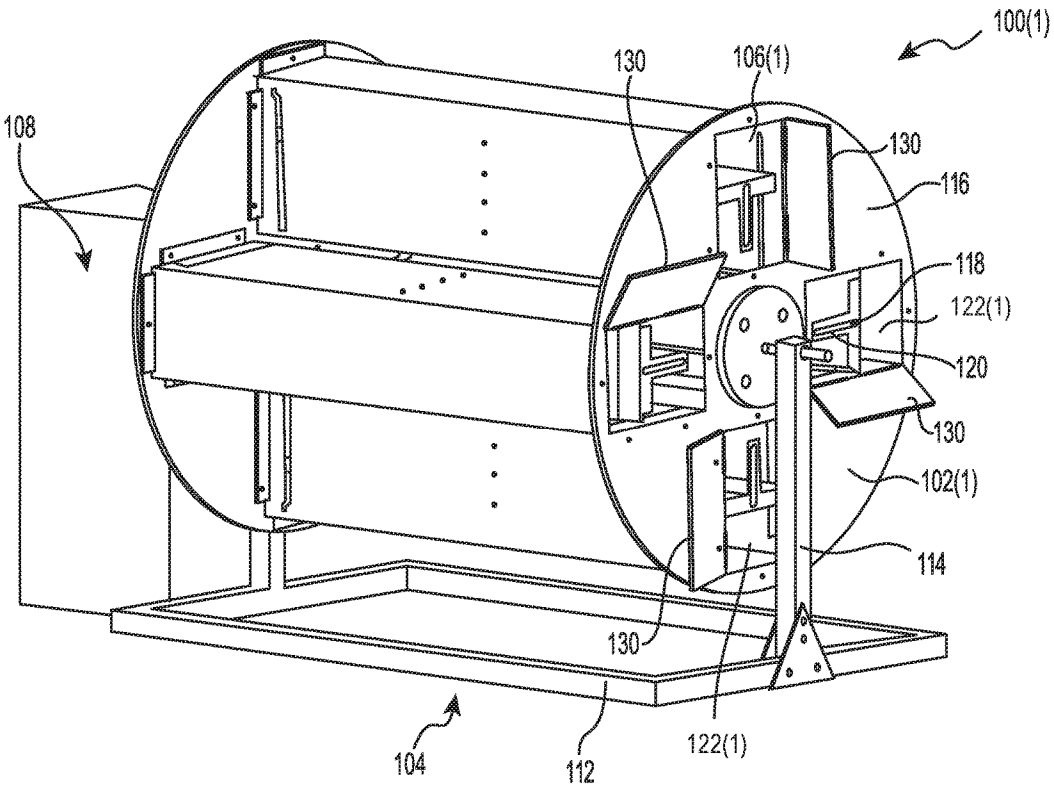

In one embodiment, as illustrated in FIGS. 1A-1C, shaft 102(1) includes a body portion 116 with the one or more mounts 106(1) configured as voids in the body portion 116 of the shaft 102(1). The one or more mounts 106(1) extend parallel to the central axis of the shaft through the body portion 116 of the shaft 102(1) along nearly the entire length of the shaft 102(1). The one or more mounts 106(1) are configured to receive one or more test tube carriers. The one or more mounts 106(1) are located symmetrically about the central axis of the shaft 102(1), although other configurations may be contemplated. By way of example only, the one or more mounts 106(1) are located at 90 degree intervals about the shaft 102(1), although other configurations, such as one or more mounts 106(1) that are located 180 degrees, 60 degrees, or 45 degrees apart about the central axis of the shaft 102(1) may be utilized.

The one or more mounts 106(1) are configured as hollow rectangular sections in the body portion 116 of the shaft 102(1), although the one or more mounts 106(1) may have other configurations. The one or more mounts 106(1) are configured to securely fit a laboratory sample rack, although the one or more mounts 106(1) may be configured to fit a plurality of lab sample racks. In one embodiment, the sidewalls of mount 106(1) may be lined with a compressible material or other material to increase friction with a loaded lab rack in order to provide a more secure fit for the loaded lab rack within the mount 106(1).

In one embodiment, the one or more mounts 106(1) include at least one adjustable sidewall 118, although other numbers of adjustable sidewalls may be contemplated. The adjustable sidewall 118 is utilized to secure a lab sample rack in place within the mount 106(1) after the lab sample rack is loaded. The adjustable sidewall 118 provides a force in the direction of the sidewall opposite the adjustable sidewall 118 to secure the lab rack in place within the mount 106(1). In one embodiment, the adjustable sidewall 118 is constructed of a pliable material, such as rubber, in order to provide the force to secure the lab rack, although other pliable materials may be utilized.

In another embodiment, adjustable sidewall includes a securing mechanism 120. The securing mechanism 120 may be a spring, such as a compression spring, a tension spring, or a torsion spring, to provide a spring loaded force, although other non-spring loaded forces may be applied through, by way of example only, a compression piston. Alternatively, adjustable sidewall 118 may be manually adjustable and securing mechanism 120 may provide a lockable source of force through a latch, lever, or other locking mechanism to maintain the position of the adjustable sidewall 118 after manual adjustment. Although securing mechanism 120 is described as a single source of force, it is understood that a plurality of securing mechanisms may be utilized to apply a symmetrical force to the lab rack along the adjustable sidewall 118.

In another embodiment, mounts 106(1) include multiple adjustable dimensions. Two adjacent sidewalls of the mount 106(1) may be adjustable in relation to the opposing sidewalls. By way of example only, the joint between the two adjacent sidewalls may include comb-like interspersed teeth that allow for adjustment, although other adjustment mechanisms may be contemplated.

The one or more mounts 106(1) include an open end 122(1) configured to receive the lab sample rack such that an operator may slide the lab sample rack into the mount 106(1). By way of example only, the open end 122(1) may include a tapered portion that facilitates insertion of the lab rack into the mount 106(1). The tapered portion may be constructed of polished metal to facilitate insertion, although other materials that provide a low source of friction between the tapered portion and the lab rack during insertion into the mount may be utilized. The mount 106(1) may further include a fastener 130 located at the open end 122(1) of the mount 106(1), such as a closable door. In one embodiment, the closable door may secure the lab rack within the mount 106(1). In another embodiment, the mount 106(1) includes a stop device 124 at the end of the mount 106(1) opposite the open end 122(1) to securely load the lab sample rack into the mount 106(1), although the mount 106(1) may include other devices at other locations to provide a secure fit for the lab sample rack in the mount. The stop device 124 may be adjustable to secure the lab rack within the mount 106(1).

Figure 2A:
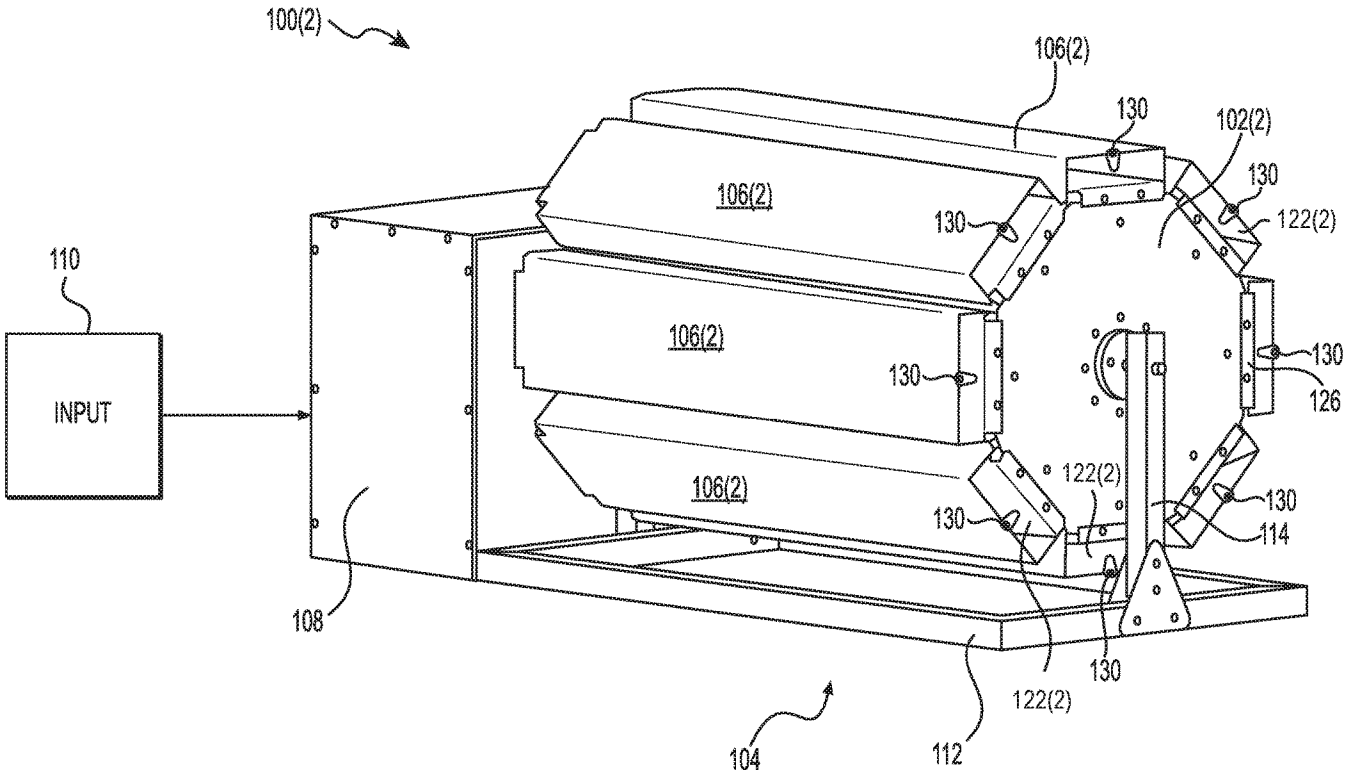
FIGS. 2A-2C are an isometric view, end view, and a side view of another exemplary embodiment of a lab rack rotator of the present disclosure.
Figure 2B:
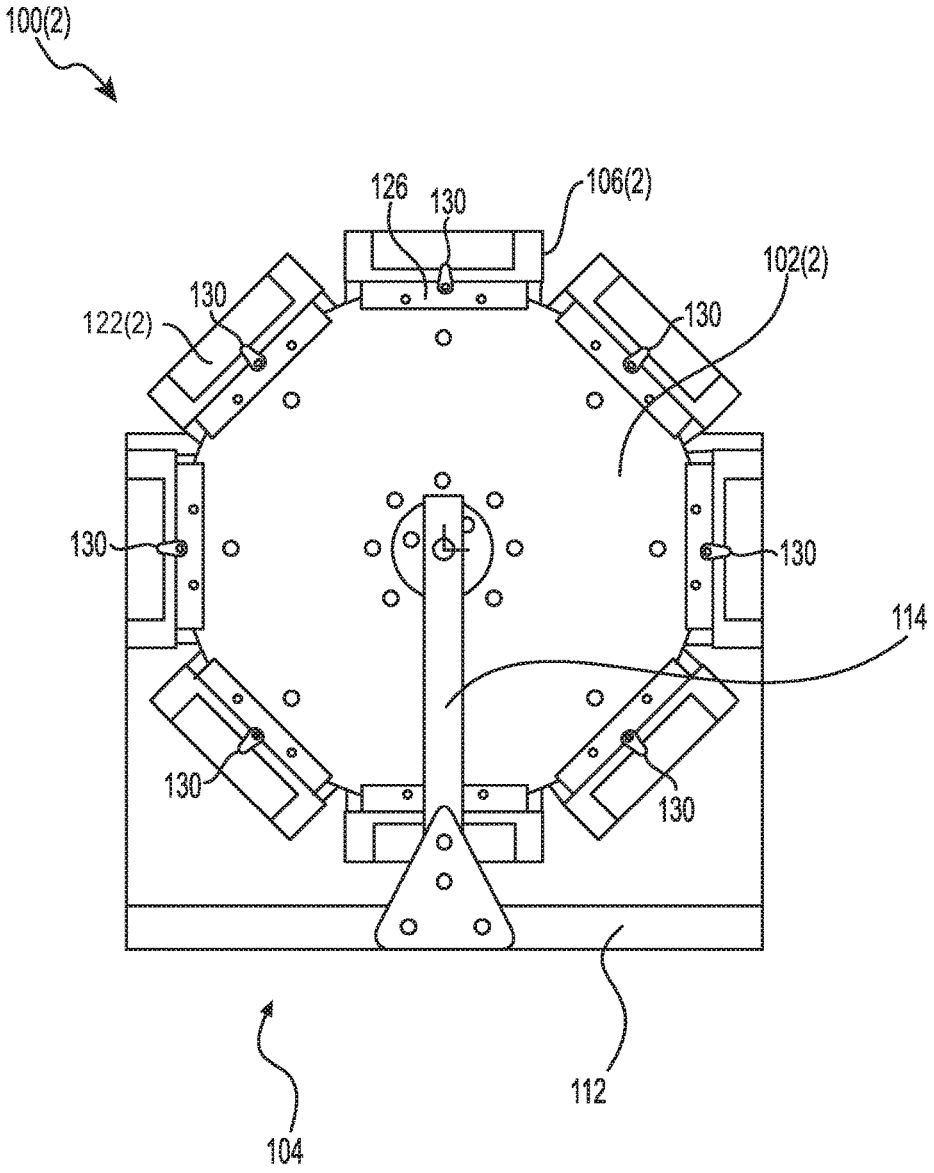
Figure 2C:
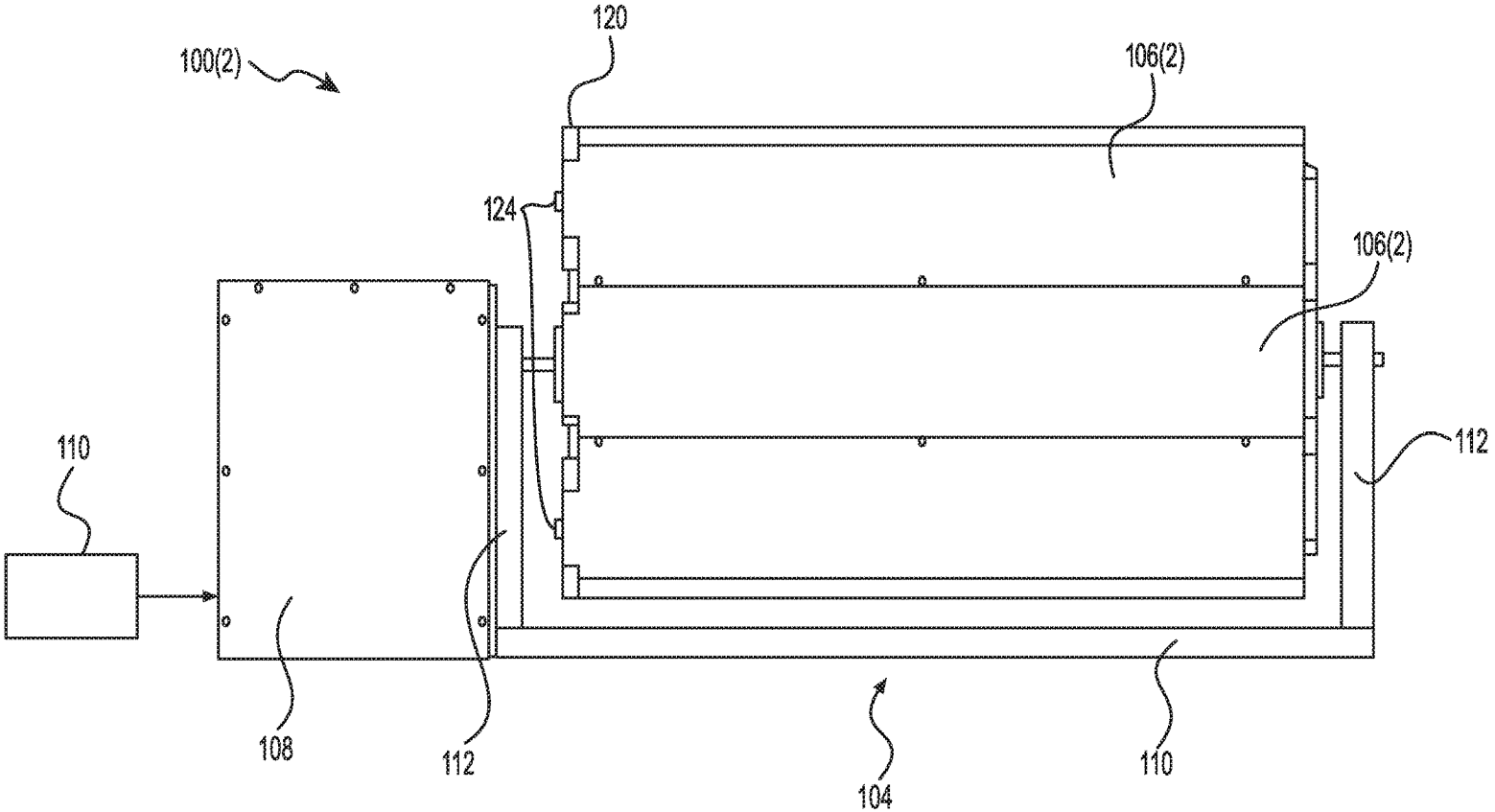

In another embodiment, as illustrated in FIGS. 2A-2C, mounts 106(2) are disposed on the shaft parallel to the central axis of the shaft, although the mounts 106(2) may be located in other positions on the shaft. The shaft 102(2) includes one or more flat sides configured to receive the mounts 106(2), although the shaft may have other configurations to suit different shapes and sizes of mounts 106(2). By way of example only, shaft 102(2) has an octagonal cross-section to receive eight mounts 106(2), although the shaft may have other configurations such as a square or circular cross-section to receive different numbers and shapes of mounts 106(2). In one example, shaft 102(2) includes attachment mechanisms 126 to removably attach mounts 106(2) to the shaft 102(2), although in other embodiments the mounts 106(2) is rigidly attached to the shaft 102(2). By way of example only, the attachment mechanisms 126 may be brackets configured to receive the mounts 106(2), although other devices for attaching the mounts 106(2) to the shaft 102(2), such as rails located on the shaft 102(2) that provide a slide fit for the mounts 106(2) to the shaft 102(2) may be contemplated. The shaft 102(2) may include different numbers and types of attachment mechanisms 126 in order to removably attach different numbers and shapes of mounts 106(2) to the shaft 102(2).

In one example, the mounts 106(2) are in the shape of a hollow casing, although the mounts 106(2) may comprise other shapes suitable to receive a standard lab sample rack. The hollow casing includes an open end 122(2) configured to receive the lab sample rack such that an operator may slide the lab sample rack into the mount 106(2). The mount 106(2) may further include a fastener 130 located at the open end 122(2) of the hollow casing and a stop device 124 at the end of the hollow casing opposite the open end 122(2) to securely load the lab sample rack into the hollow casing, although the mount 106(2) may include other devices at other locations to provide a secure fit for the lab sample rack in the mount. In the example shown in FIGS. 2A-2C, the shaft 102(2) includes eight mounts 106(2) and the open ends 122(2) of seven of the mounts 106(2) are configured to receive the lab sample rack without reorientation of the shaft 102(2). The eighth mount can be loaded by turning the rotator sufficiently to expose the open end of the eighth mount.

Referring again to FIGS. 1A-2C, the shaft 102(1), 102(2) is coupled to a motor 108. The motor 108 is configured to drive the shaft 102(1), 102(2) to cause the shaft 102(1), 102(2) to rotate in at least one direction about the central axis of the shaft 102(1), 102(2), although the motor 108 may have the capability to drive the shaft 102(1), 102(2) in both directions. The motor may optionally be enclosed in a motor enclosure. In one example, the motor is capable of rotating the shaft at a rate of at least 10 rotations per minute, although the motor may have the ability to rotate the shaft at various rates of speed.

The motor 108 is coupled to and may be operated by the input device 110. The input device 110 may allow a user to initiate rotation of the shaft 102(2) in either direction, control the speed of rotation, or initiate or control any other function of the motor. In one example, the input device 110 may allow a user to rotate the shaft 102(2) for a preset number of rotations, such as four complete rotations, although the input device 110 may provide other functions such as rotating the shaft 102(2) for a preset period of time. The input device 110 may further allow a user to rotate the shaft 102(2) less than a full rotation, for example, to reorient the shaft 102(2) in order to load a lab sample rack into a mount 106(2) that is being blocked by the support structure 104.

Figure 3:
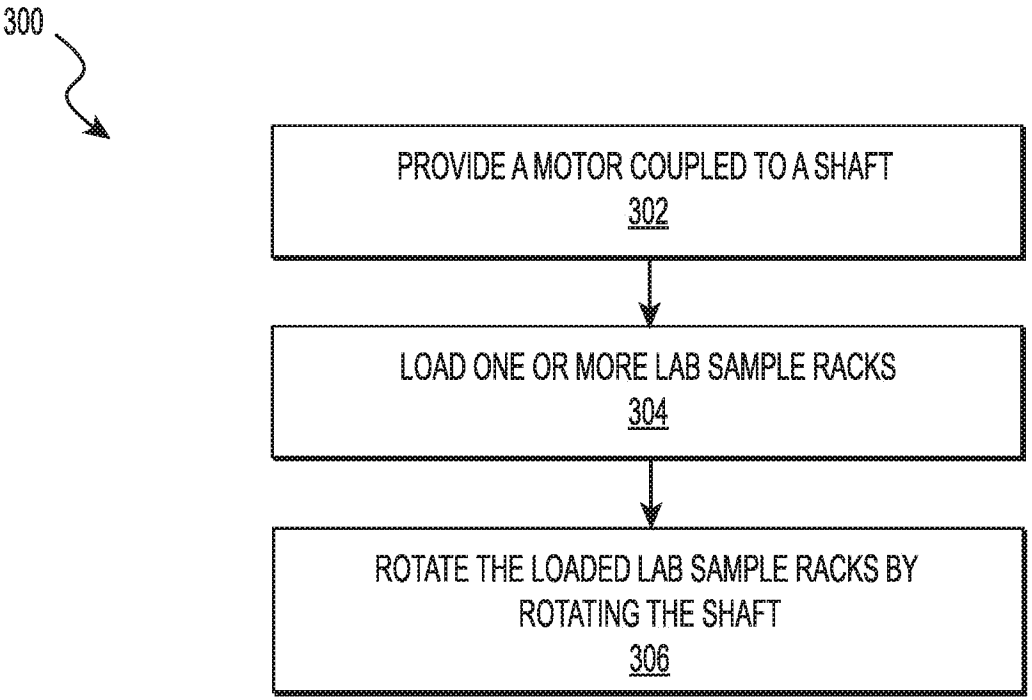
FIG. 3 is a flowchart for a method for agitating a plurality of lab samples.

Referring to FIG. 3, a method for agitating a plurality of lab samples utilizing the lab sample rack rotator 100(1), 100(2) will be described using flow chart 300 with reference back to FIGS. 1A-2B.

In step 302, a motor coupled to a shaft, such as motor 108 and shaft 102(1), 102(2), are provided. In one example, in step 302, providing the motor 108 coupled to the shaft includes providing a shaft that is arranged to rotate in at least one direction in response to the motor. Step 302 further includes providing a shaft that includes a number of mounts, such as mounts 106(1), 106(2), that are located along the shaft. The mounts may be integrated into the shaft or may be separately disposed on the surface of the shaft. The mounts 106(1), 106(2) are configured to receive a lab sample rack which holds a number of lab samples.

In step 304, one or more lab sample racks are loaded into the mounts 106(1), 106(2). In one example, the lab sample racks are loaded such that the lab samples are maintained in a direction perpendicular to the length of the shaft 102(1), 102(2). By way of example only, the lab sample racks may be slid by the user into the mount 106(1), 106(2). Each mount is capable of receiving a complete rack of samples, although mounts may be configured to receive a plurality of racks.

In one example, loading the lab sample racks into mounts 106(1), 106(2) includes loading at least one of the one or more lab sample racks into mounts 106(1), 106(2) that are accessible for loading a lab sample rack. The shaft 102(1), 102(2) is reoriented by rotating the shaft 102(1), 102(2) to a position where additional mounts 106(1), 106(2) are accessible to load a lab sample rack. By way of example, a mount 106(1), 106(2) may be unavailable due to being blocked by the arm 114 of the support structure 104. The rotation of the shaft 102(1), 102(2) to provide reorientation for additional loading in this example is less than 360 degrees. After reorientation, additional lab sample racks are loaded into the remaining previously inaccessible mounts 106(1), 106(2). In one example, as shown in FIGS. 2A-2C, eight mounts 106(2) may be disposed on the shaft 102(2)

with seven of the eight mounts 106(2) configured to receive the lab sample rack without reorientation of the shaft 102(2). In this example, the shaft 102(2) may be reoriented by 45 degrees to provide access to the eighth mount for loading.

Referring again to FIG. 3, in step 306, the loaded lab sample racks are rotated by rotating the shaft 102(1), 102(2) by initiating the motor 108 using input device 110. Rotating the shaft 102(1), 102(2) causes the lab samples to be inverted to achieve agitation of the samples. In one example, the rotating of the lab sample racks includes rotating the shaft 102(1), 102(2) at a rate of at least 10 rotations per minute, although the shaft may be rotated at other rates. In one example, rotating the loaded lab sample racks includes rotating the shaft 102(1), 102(2) for at least four full rotations, although the number of rotations may be varied. In one example, complete agitation of the samples is achieved in at most 30 seconds.

In one example, the method described by flowchart 300 is utilized to agitate whole blood samples, although the method may be used to agitate other types of samples including other types of blood samples, such as serum or plasma.

In one example, the method described by flowchart 300 is utilized to agitate at least 192 samples simultaneously, although more or less samples may be agitated.

Having thus described the basic concept of the invention, it will be rather apparent to those skilled in the art that the foregoing detailed description is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Accordingly, the invention is limited only by the following claims and equivalents thereto.

What is claimed is:

1. A lab sample rack rotator comprising:

a motor coupled to a shaft, the shaft arranged to rotate in at least one direction in response to the motor; and one or more mounts along the shaft, the one or more mounts configured to receive a lab sample rack configured to hold a plurality of lab sample containers and comprising:

an open end, a spring loaded-adjustable sidewall wherein the spring loaded-adjustable sidewall is configured to limit movement of the plurality of samples in the received sample rack and comprises a lockable securing system, one or more fasteners to secure the open end of the one or more mounts, and a stop device opposite the open end and arranged to securely locate the lab sample rack in the one or more mounts, wherein rotation of the shaft permits inversion of the plurality of lab sample containers, and wherein the one or more mounts provide a secure fit for the lab sample rack based on the longest dimension of the lab sample containers.

2. The lab sample rack rotator of claim 1 wherein the plurality of lab samples in the lab sample rack are maintained in a direction perpendicular to a length of the shaft.

3. The lab sample rack rotator of claim 1 wherein eight or more mounts are along the shaft.

4. The lab sample rack rotator of claim 3 wherein at least seven mounts are configured to receive the lab sample rack without reorientation of the shaft.

5. The lab sample rack rotator of claim 1 wherein the motor rotates the shaft at a rate of at least 10 rotations per minute.

6. The lab sample rack rotator of claim 1 wherein the one or more mounts are disposed on a surface of the shaft.

7. The lab sample rack rotator of claim 6 wherein the one or more mounts are removably attached to the shaft.

8. The lab sample rack rotator of claim 1 wherein the one or more mounts are voids in a body portion of the shaft.

9. The lab sample rack rotator of claim 1 wherein the spring loaded-adjustable sidewall is configured to provide a force in the direction of the sidewall opposite the adjustable sidewall.

10. The lab sample rack rotator of claim 1 wherein the spring loaded-adjustable sidewall spans the length of said mount.

* * * * *